US009777980B2

(12) United States Patent
Heizer

(10) Patent No.: US 9,777,980 B2
(45) Date of Patent: Oct. 3, 2017

(54) COMPACT SEMI-AUTOMATIC FIREARM

(71) Applicant: Charles K. Heizer, St. Louis, MO (US)

(72) Inventor: Charles K. Heizer, St. Louis, MO (US)

(73) Assignee: Heizer Defense, LLC, Pevely, MO (US)

( * ) Notice: Subject to any disclaimer, the term of this patent is extended or adjusted under 35 U.S.C. 154(b) by 256 days.

(21) Appl. No.: 14/486,633

(22) Filed: Sep. 15, 2014

(65) Prior Publication Data

US 2017/0108304 A1 Apr. 20, 2017

Related U.S. Application Data

(60) Provisional application No. 61/877,652, filed on Sep. 13, 2013.

(51) Int. Cl.

| | |
|---|---|
| ***F41A 21/48*** | (2006.01) |
| ***F41C 3/00*** | (2006.01) |
| ***F41A 19/14*** | (2006.01) |
| ***F41A 19/10*** | (2006.01) |
| ***F41A 19/12*** | (2006.01) |
| ***F41A 17/46*** | (2006.01) |

(52) U.S. Cl.

CPC ..... *F41A 21/488* (2013.01); *F41A 17/46* (2013.01); *F41A 19/10* (2013.01); *F41A 19/12* (2013.01); *F41A 19/14* (2013.01); *F41C 3/00* (2013.01)

(58) Field of Classification Search

CPC ..... F41A 21/488; F41A 21/36; F41A 21/48; F41A 21/26; F41A 21/00

See application file for complete search history.

(56) References Cited

U.S. PATENT DOCUMENTS 580,926 A * 4/1897 Browning ..... F41A 3/86 42/7
580,935 A 4/1897 Ehbets
621,747 A * 3/1899 Browning ..... F41A 3/86 42/1.04
663,955 A 12/1900 Burgess
(Continued)

OTHER PUBLICATIONS

International Search Report with Written Opinion of the International Searching Authority, International Application No. PCT/US2015/050240, dated Jun. 2, 2016, 13 pages.

*Primary Examiner* — Michelle R Clement
*Assistant Examiner* — Bridget Cochran
(74) *Attorney, Agent, or Firm* — Creativenture Law, LLC; Dennis J M Donahue, III

(57) ABSTRACT

A firearm has a frame, a barrel assembly and a slide assembly which holds a recoil assembly. The slide and recoil assemblies are located above the barrel so that the barrel is situated between the topmost part of the frame and the bottom of the slide assembly. The barrel assembly includes a housing which is covered by the slide assembly and secures one side of the recoil assembly. The barrel assembly can be removably connected to the frame through front and rear mounts that may be secured using removable pins. The barrel assembly can modularly connect with the frame and slide assembly so that different caliber barrels can be interchanged with each other using the same frame and slide assembly. The firearm is operated by the firing system which includes the trigger assembly and linear striker assembly.

20 Claims, 14 Drawing Sheets

(56) References Cited

U.S. PATENT DOCUMENTS

| | | | | | |
|---|---|---|---|---|---|
| 747,585 | A * | 12/1903 | Browning | F41A 17/64 | 42/7 |
| 1,388,856 | A | 8/1921 | Fox | | |
| 2,489,816 | A * | 11/1949 | Reilly | F41A 25/22 | 42/75.01 |
| 2,627,686 | A * | 2/1953 | Shockey | F41A 3/86 | 42/1.06 |
| 3,150,458 | A * | 9/1964 | Browning | F41A 21/484 | 42/75.02 |
| 3,675,534 | A | 7/1972 | Beretta | | |
| 3,830,002 | A * | 8/1974 | Volkmar | F41A 17/72 | 42/70.08 |
| 3,857,322 | A * | 12/1974 | Lichtman | F41A 3/82 | 42/15 |
| 4,048,901 | A | 9/1977 | Ghisoni | | |
| 4,109,403 | A * | 8/1978 | Badali | F41A 21/488 | 42/75.02 |
| 4,127,056 | A * | 11/1978 | Kart | F41A 21/488 | 42/75.02 |
| 4,173,169 | A * | 11/1979 | Yates | F41A 5/04 | 42/112 |
| 4,475,438 | A | 10/1984 | Sullivan | | |
| 4,594,935 | A * | 6/1986 | Smith | F41A 17/36 | 42/75.02 |
| 5,086,578 | A * | 2/1992 | Lishness | F41A 19/32 | 42/69.02 |
| 5,127,310 | A * | 7/1992 | Lishness | F41A 3/86 | 42/108 |
| 5,259,138 | A * | 11/1993 | Scirica | F41A 17/72 | 42/70.08 |
| 5,320,023 | A * | 6/1994 | Erdem | F41A 3/66 | 42/7 |
| 5,448,940 | A | 9/1995 | Schuetz | | |
| 6,381,892 | B1 | 5/2002 | Szabo | | |
| 7,201,094 | B2 * | 4/2007 | Jebsen | F41A 3/56 | 42/28 |
| 7,937,876 | B1 | 5/2011 | Graham | | |
| 8,061,255 | B1 | 11/2011 | Boberg | | |
| 8,522,466 | B2 * | 9/2013 | Arduini | F16D 41/12 | 42/69.01 |
| 8,832,983 | B1 * | 9/2014 | Wolf | F41A 3/12 | 42/16 |
| 2004/0159033 | A1 * | 8/2004 | Rohrbaugh | F41A 5/04 | 42/69.03 |
| 2006/0156607 | A1 | 7/2006 | Curry | | |
| 2008/0034955 | A1 | 2/2008 | McGarry | | |
| 2011/0289813 | A1 * | 12/2011 | Serandour | F41A 21/488 | 42/76.01 |
| 2012/0297971 | A1 | 11/2012 | Lester | | |
| 2014/0053445 | A1 * | 2/2014 | Wolf | F41A 3/12 | 42/14 |
| 2014/0216243 | A1 * | 8/2014 | Coffman, II | F41A 3/82 | 89/196 |
| 2014/0317979 | A1 | 10/2014 | Carlson | | |

* cited by examiner

COMPACT SEMI-AUTOMATIC FIREARM

CROSS-REFERENCE TO RELATED APPLICATIONS

This application claims priority to U.S. Provisional Patent Application No. 61/877,652 filed on Sep. 13, 2013 which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a semi-automatic pistol, and more particularly to semi-automatic pistols with the recoil mechanism positioned above the barrel.

Related Art

Known firearms generally experience kickback and muzzle climb due to discharge gases when the firearm is fired. Kickback is created by a forward momentum of the bullet and results in a rearward acting force upon the firearm and the marksman. Additionally, muzzle climb is caused by a torque which creates an upward movement of the barrel when the firearm is discharged. Recoil and muzzle climb typically increase with the size of the bullet or projectile. Moreover, there is typically an inverse relationship between the weight of the firearm and the kickback effects such that a lower weight firearm produces an increased kickback and muzzle climb transferred to the operator of the firearm. Kickback and muzzle climb may cause marksmen to flinch or hesitate when discharging the firearm, thereby resulting in less control of the firearm. Additionally, muzzle climb and recoil may lead to fatigue in the marksman and may inhibit the marksman's ability to repeatedly discharge the firearm. Kickback and muzzle climb can cause the marksman to move out of alignment with the target after each round is fired requiring additional setup time for each subsequent shot. As such, kickback and muzzle climb greatly decrease the accuracy of the marksman.

Most prior art semi-automatic pistols either have recoil mechanisms beneath the barrel or, around the barrel in some cases, and there are a few instances in which the recoil mechanisms are above the barrel. However, pistols with the recoil mechanism beneath the barrel create a higher torque from the kickback or "recoil" upon discharging the firearm due to the offset of the barrel from the position of the operator's hand. The larger the offset distance, the greater the counterforce that the operator of the firearm must exert to overcome the torque and maintain control after discharging the firearm, resulting in discomfort and increased fatigue to the operator of the firearm. In traditional semi-automatic pistols in which an ammunition magazine (or clip) slides into the butt handle of the firearm, the centerline of the barrel is offset by approximately an inch or higher than the top of the trigger and the top of the handle where the operator's hand is located. Even with compact semi-automatic pistols, nearly an inch offset is typical. None of these traditional prior art pistols have the recoil mechanism positioned above the barrel. Some pistols may be variations of rifles which may have a top-mounted recoil mechanism. However, these pistols typically have the ammunition magazine located forward of the trigger and produce an even larger offset distance between the barrel and the trigger.

Furthermore, the gun barrels in many prior art firearms move during operation of the firearm, either sliding or rotating. This movement can negatively impact the accuracy of the firearms, since this creates a floating-type moment when firing the weapon. However, as indicated in U.S. Pat. No. 747,585 it has generally been considered that the closer location of the barrel to the sighting line would result in increased accuracy. Additionally, there has been a desire to replace barrels without the need for any tool, and typically, barrels located above the recoil assembly have provided this ability.

In those firearms in which the barrel is situated below the recoil mechanism, it would be beneficial to permit the replacement of the barrel without the need for any tool. Additionally, there would be additional benefits to a barrel that is connected directly to the frame and does not move which can provide a stable, unmoving platform to hold the recoil mechanism to reduce the complexity of the firearm and minimize the moving parts in the firearm.

SUMMARY OF THE INVENTION

Embodiments of the present invention comprise a firearm with a frame, a barrel assembly and a slide assembly containing a recoil assembly. The slide and recoil assemblies are located above the barrel so that the barrel is situated between the topmost part of the frame and the bottom of the slide assembly. The barrel assembly includes a housing which is covered by the slide assembly and secures the side of the recoil assembly proximate to the breech plate.

The firearm of the present invention is also designed to have modular barrel assemblies that are interchangeable with each other so that different caliber gun barrels can use the same frame and slide assembly. The modular barrel assemblies are connected to the frame with takedown pins which permit quick removal and replacement without any tools apart from the cartridges used in the firearm. Alternatively, the barrel assembly may be formed with and permanently attached to the frame.

The removable connection of the barrel assembly to the frame are preferably through front and rear mounts that may be secured using the removable takedown pins.

Further areas of applicability of the present invention will become apparent from the detailed description provided hereinafter. The detailed description and specific examples of the invention in the specification and drawings are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1C:
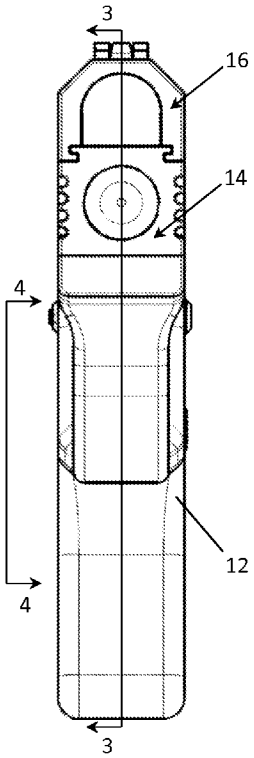
FIG. 1C is a front view of the firearm of the present invention.
Figure 1A:
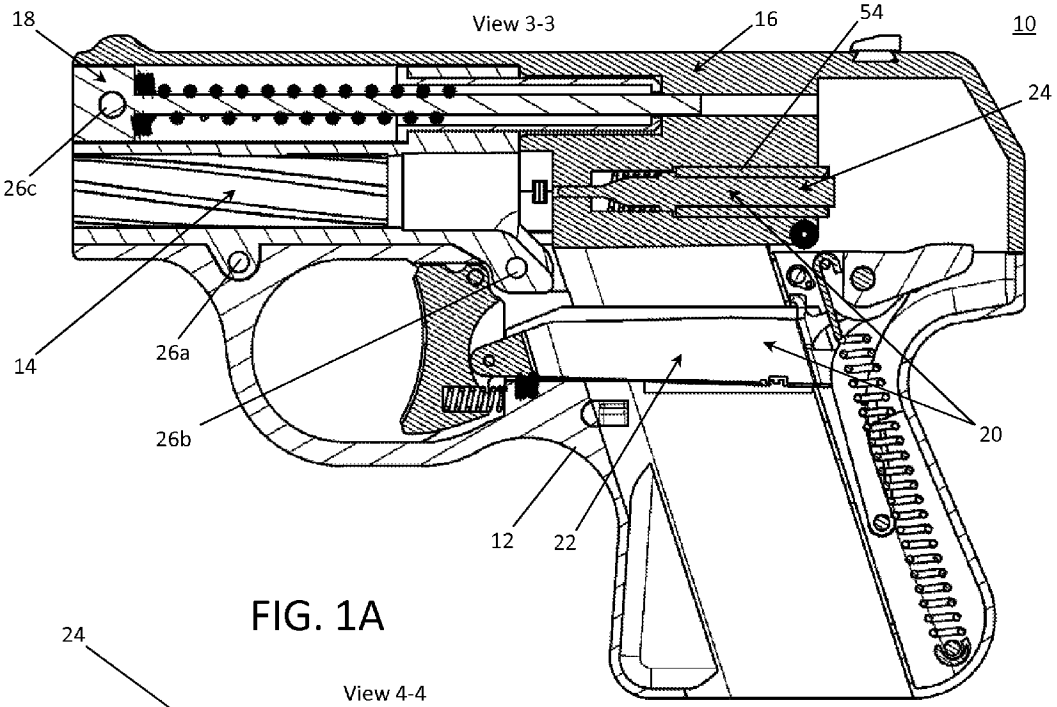
FIG. 1A is a cross-sectional view of a firearm of the present invention.
Figure 1B:
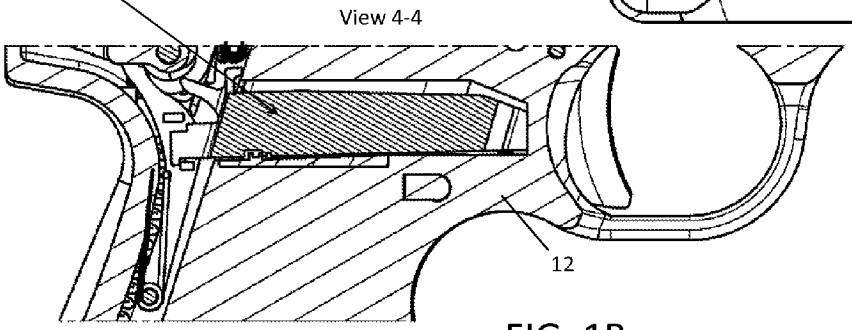
FIG. 1B is a partial cross-sectional view of the firearm of the present invention.

The following description of the preferred embodiment(s) is merely exemplary in nature and is in no way intended to limit the invention, its application, or uses. Generally, as shown in FIGS. 1-3, the firearm 10 of the present invention includes a frame 12, a barrel assembly 14 and a slide assembly 16 that contains a recoil assembly 18. The slide and recoil assemblies are located above the gun barrel 14*a* so that the barrel is situated between the topmost part of the frame and the bottom of the slide assembly. The barrel assembly 14 includes a housing 14*b* which is covered by the slide assembly 16 and secures one side of the recoil assembly 18. The barrel assembly can be removably connected to the frame through front and rear mounts 14*c*, 14*d* that may be secured using removable pins 26. The barrel assembly can modularly connect with the frame and slide assembly so that different caliber barrels 14', 14" can be interchanged with each other using the same frame and slide assembly. The firearm is operated by the firing system 20 which includes a trigger assembly 22 and linear striker assembly 24.

The frame 12 has a handle portion 12*a* and a trigger portion 12*b*. The handle portion has a left side and a right side extending from the trigger portion to a butt end 12*c* of the frame. The sides each have a side aperture 32*a* proximate to the trigger portion and a lip 12*d* that is proximate to the top end of the handle portion and extends along the top end to the butt end of the handle portion. The trigger portion has an arm 12*e* extending from the handle portion and a cavity 34 recessed from a top face of the arm 12*f*. A pair of sides of the arm extends from the sides of the handle portion to form a pair of side walls on opposite sides of the cavity, and each of the side walls has a side wall aperture 36*a*.

Figures 3A, 3B:
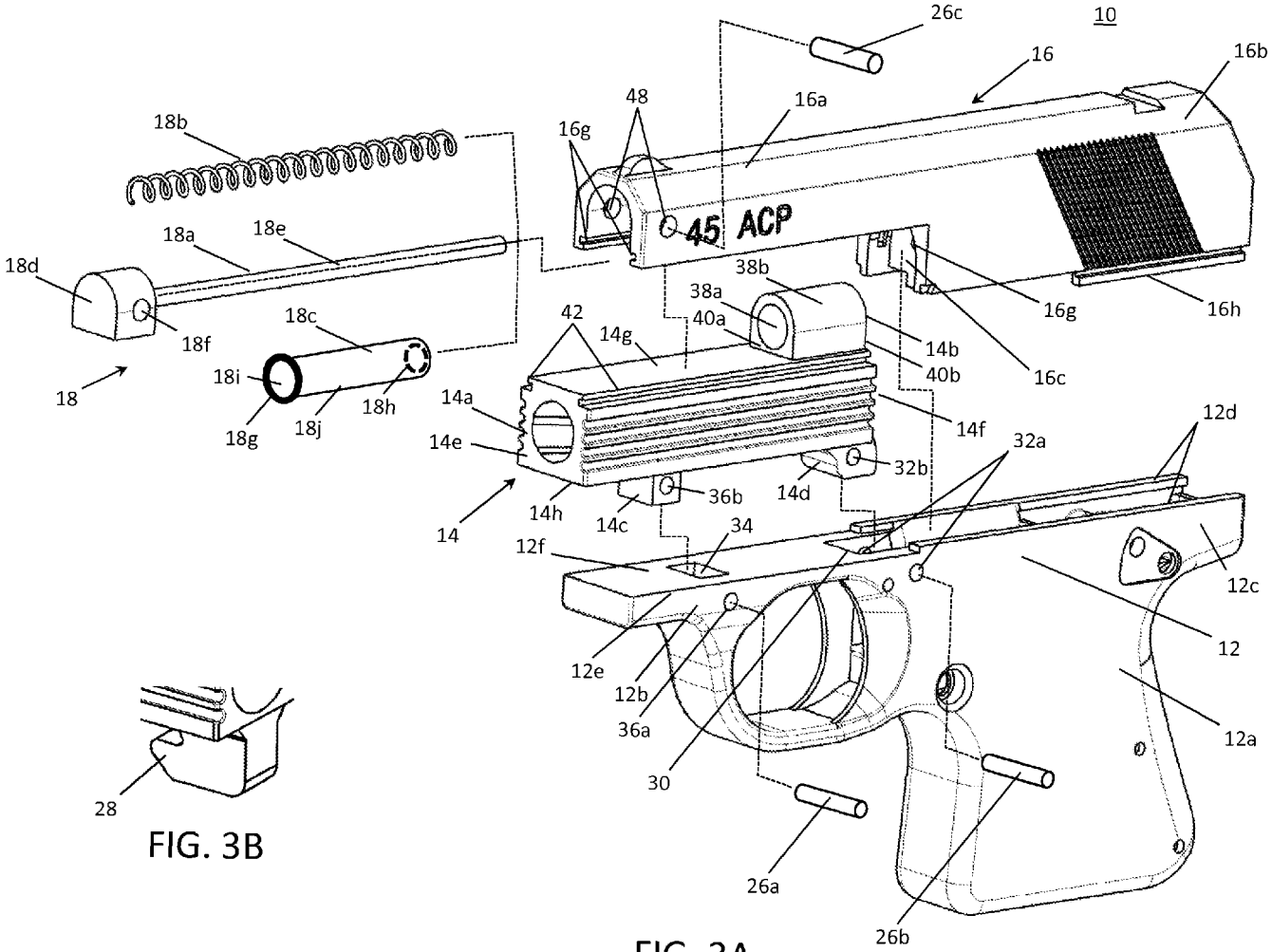
FIG. 3A is an exploded isometric view of the firearm of the present invention.
FIG. 3B is a detail isometric view of an alternative mount for barrel assemblies.

The barrel assembly 14 is positioned adjacent to the top face of the arm. The barrel assembly includes a gun barrel 14*a*, a housing 14*b*, a front mount 14*c*, and a rear mount 14*d* and has a front portion 14*e*, a rear portion 14*f*, a top side 14*g*, and a bottom side 14*h*. The front and back mounts extend from the bottom side of the front and back portions, respectively. The housing 14*b* extends from the top side of the gun barrel and has inner and outer surfaces 38*a*, 38*b* and front and back surfaces 40*a*, 40*b*. The top side includes a pair of longitudinal ribs 42 extending between the front portion and the rear portion. The front mount is seated in the cavity and has a front aperture 36*b* aligned with the side wall aperture 36*a* in each of the side walls. The rear mount is seated between the first side and the second side and has a rear aperture 32*b* aligned with the side apertures 32*a*. As shown in FIG. 3A, the mounts are preferably pinned. However, as particularly shown in FIG. 3B, a latch mount 28 may be used in place of either one of the pin mounts. The latch mount would engage with a catch 30 on the frame and then the pin mount would be locked in place, preferably with a takedown pin.

Figures 2A, 2B, 2C, 2D:
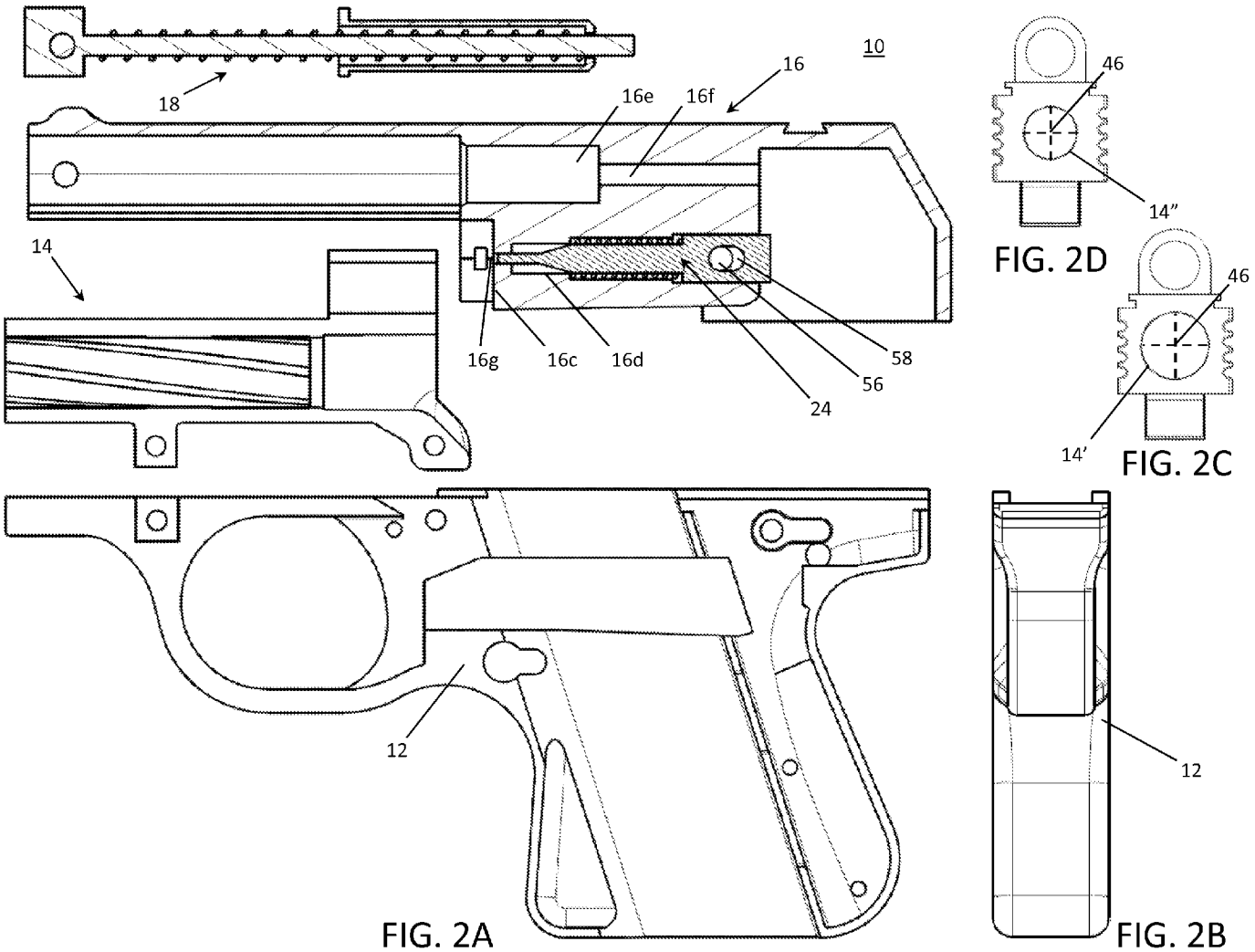
FIG. 2A is an exploded cross-sectional view of the firearm of the present invention.
FIG. 2B is a front view of the frame of the firearm.
FIGS. 2C and 2D are front views of interchangeable barrel assemblies for the firearm.

The takedown pin locks the barrel assembly to the frame and can be dislodged from the pin aperture using a standard caliber cartridge 44. The user can then pull the pin out of the aperture to remove the barrel assembly 14 from the frame 12. The barrel assembly 14 can interchangeably connect with the frame 12 and the slide assembly 16 in a modular manner. For example, one barrel assembly 14' can be one caliber (.45) while another barrel assembly 14" can be a different caliber (9 mm), as shown in FIGS. 2C and 2D, respectively. These barrel assemblies 14 are interchangeable with each other, and the centerline 46 of each gun barrel aligns with the firing pin hole 16*g* in the breech plate 16*b*. It is possible to have different breech plate inserts which may have different sized holes that are optimized for the strikers used for different caliber ammunition, but the centerline of the gun barrels are all designed to be aligned with the center of the firing pin hole in the breech plate. To lock the barrel assembly to the frame, a takedown pin 26*a* extends through the aperture in the front mount and the side wall aperture in each one of the side walls. Similarly, a takedown pin 26*b* extends through the aperture in the rear mount and the side apertures in the frame.

The slide assembly 16 includes a front casing 16*a*, a rear casing 16*b*, a breech plate 16*c*, a firing pin bore 16*d*, an internal recess 16*e*, and a conduit 16*f* between the internal recess and the rear casing. As indicated above, the breech plate has a firing pin hole 16*g* aligned with the firing pin bore 16*d*. The front casing extends from the internal recess to a distal end around the nose portion of the recoil rod. The front casing mates with the barrel and encloses the recoil assembly in an interior space between the front casing and the top side of the barrel. The front casing has a pair of apertures 48 at the distal end and a pair of inwardly-facing grooves extending from the distal end to a location proximate to the internal recess. The pair of 16*h'* longitudinal ribs slide in the pair of inwardly-facing grooves. The rear casing has a pair of outwardly-facing grooves 16*h"*, and the first lip and the second lip slide in the pair of outwardly-facing grooves. The back surface of the housing abuts the internal recess and the recoil assembly sleeve continues through the housing and is seated at the back wall of the internal recess.

The recoil assembly 18 includes a rod 18*a*, a helical spring 18*b* and a sleeve 18*c*. The recoil rod 18*a* has a nose portion 18*d* and an elongated rod 18*e* extending from the nose portion. The nose portion has a bore 18*f*. The sleeve 18*c* has a flange 18*g* around an open end at the front and an annular rib 18*h* at an opening at the back end. The elongated rod extends through an interior portion 18*i* of the sleeve and projects out the opening at the back end. The helical spring 18*b* surrounds the elongated rod 18*a* and is contained between the nose portion and the annular rib. An outer surface 18*j* of the sleeve is contained within the inner surface 38*a* of the housing 14*b*, and the flange 18*g* abuts the front surface 40*a* of the housing 14*b*. The recoil assembly 18 is preferably connected to the slide assembly by another takedown pin 26*c*. The pin extends through the pair of apertures in the front casing of the slide assembly and through the bore in the nose portion of the recoil assembly. It will be appreciated that any standard fastener can be used to connect the recoil assembly to the slide assembly.

Figure 4:
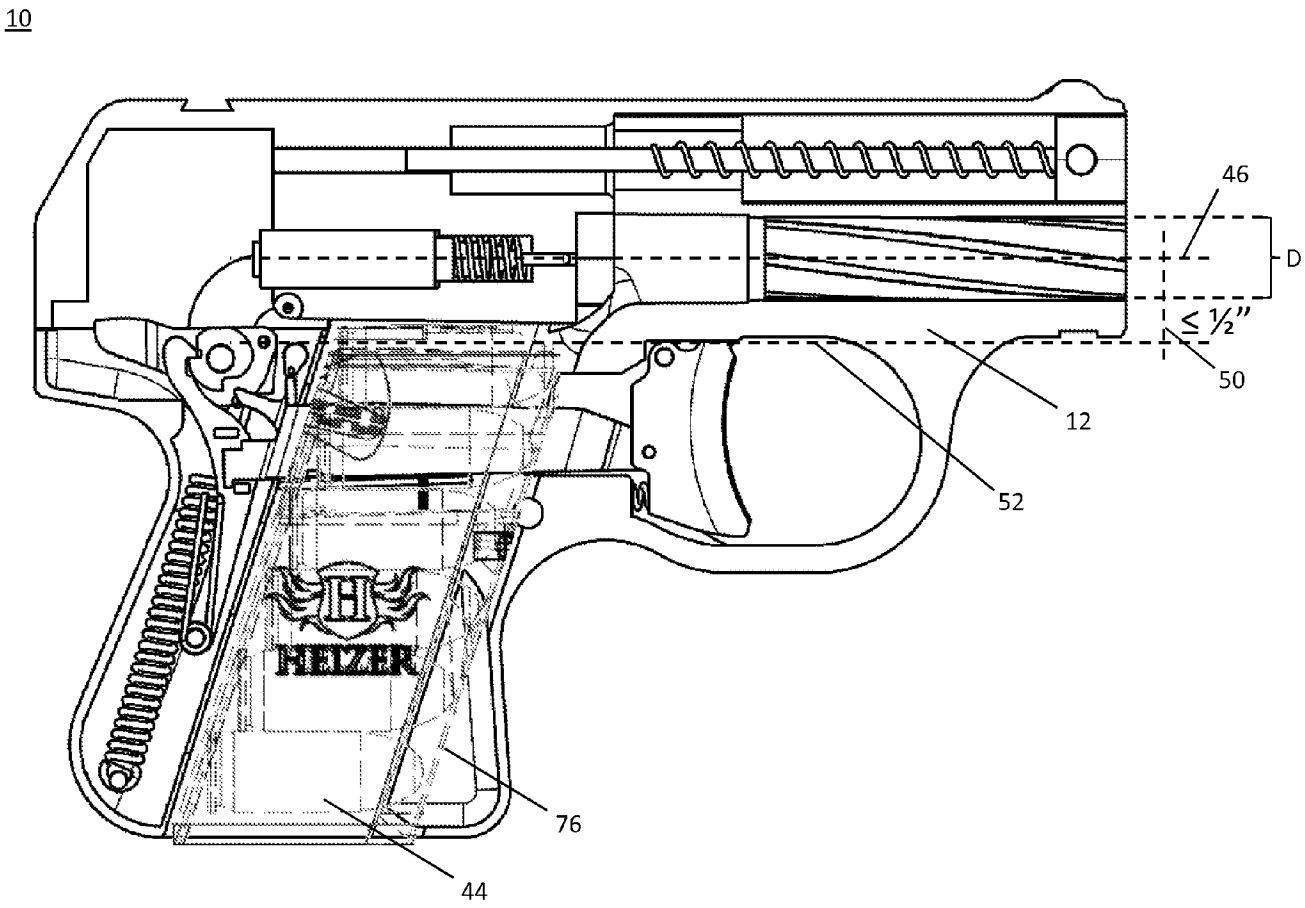
FIG. 4 is a cross-sectional view of an alternative design of the firearm showing an ammunition clip in the handle.

It is also possible to form the barrel assembly with the frame so that they are permanently attached to each other. This embodiment is shown in FIG. 4. Regardless of whether the barrel assembly and frame are integrally formed with each other or are separate parts which use fasteners to lock them together, an offset distance 50 between the gun barrel's centerline 46 and the trigger pull's topmost exposed portion 52 of is less than the gun barrel's diameter (D). As discussed in further detail below, the centerline of the gun barrel is positioned at or less than one-half inch (½") from the trigger pull's topmost exposed portion 52.

Figure 3C:
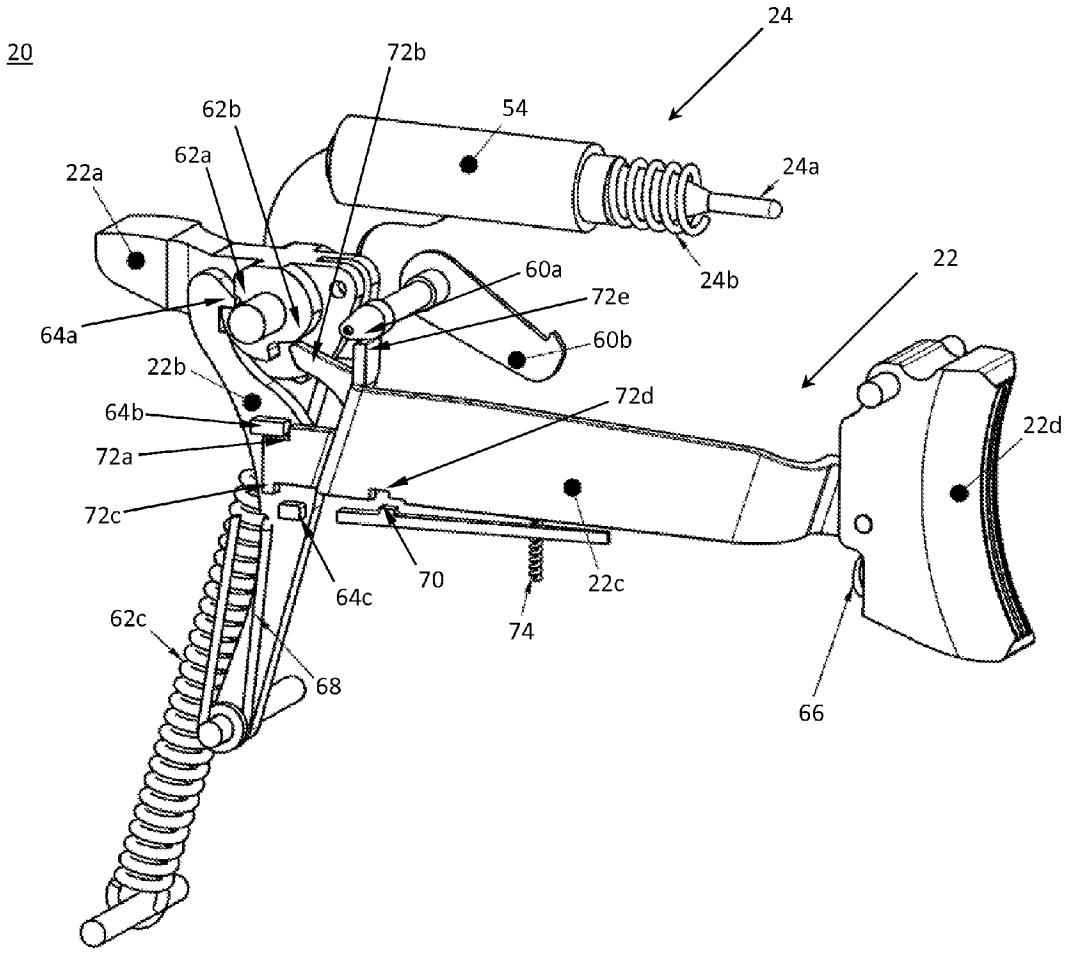
FIG. 3C is an isometric view of the firing system with the trigger assembly and the linear striker assembly.

The firing system 20 includes a trigger assembly 22 and a linear striker assembly 24 as particularly illustrated in FIG. 3C. The linear striker assembly includes the firing pin 24*a* and the firing pin spring 24*b* which are seated in the firing pin bore 16*d* in the slide assembly 16. The linear striker assembly may also include a bushing 54 as shown in FIG. 1A or a tab 56 with a slot 58 as shown in FIG. 2A to maintain the firing pin in its proper position in the firing pin bore.

The trigger assembly 22 includes a hammer 22*a*, a sear 22*b*, a lever arm 22*c* that extends between the trigger pull 22*d* and the sear and hammer and various springs which bias the components of the trigger assembly in various positions and orientations. The safety mechanism includes the safety switch 60 that has a cam 60*a* that is inside the firearm's frame and is connected to a toggle bar 60*b* that is on the outside of the firearm. The toggle bar rotates the cam between a safety-on position and a safety-off position. As explained in detail below, the other features in the safety mechanism are formed as a part of the frame, the sear and the lever arm.

The hammer 22*a* is pivotally mounted to the frame so that it rotates between its cocked orientation and its discharge orientation. The hammer has a catch surface 62*a* and a cam surface 62*b* which interact with the sear and lever arm as described in detail below. Generally, the sear engages the catch surface to hold the hammer in its cocked position, and the cam surface engages the lever arm to disengage it from the sear and push it down to the firing detent 70 when the hammer rotates from its cocked orientation to its discharge orientation. The hammer spring 62*c* biases the hammer to its discharge orientation.

The sear 22*b* engages the hammer 22*a* with a latching position that holds the hammer in its cocked orientation. In particular, the sear has a latch 64*a* which engages the catch surface when the sear is in its latching position and the hammer is in said cocked position. When the safety is off and the trigger is squeezed, i.e. moved from its rest position to its pulled position, the lever arm is actuated so that it pushes the sear to its releasing position which is where the latch falls away from the catch surface. A trigger spring 66 biases the trigger in the rest position, and the sear's latch is biased toward the catch by a sear spring 68. The sear preferably includes a tab 64*b* which extends from a side of the sear and is acted on by the lever arm, and the sear spring also biases the sear's tab toward the lever arm. When the sear is at its releasing position, the catch surface is no longer held by the latch, and the hammer spring forces the hammer to rotate from its cocked orientation to its discharge orientation. The sear also preferably includes a safety catch 64*c* which extends from the same side of the sear as the tab and also interacts with the lever arm when the safety is on.

The lever arm 22*c* interacts with and contacts the safety switch and all other components of the trigger assembly, particularly including the trigger, the sear and the hammer. Accordingly, the components of the lever arm are used when operating the firearm with the trigger assembly and when securing the firearm with the safety mechanism. The lever arm is rotatably connected to the trigger through a pivot pin and has a ram 72*a*, an extension 72*b*, a hook 72*c* and a notch 72*d* through which the lever arm engages the other components of the trigger assembly in either a firing-ready arrangement to operate the firearm or in a safety arrangement to secure the firearm.

In the lever arm's ready position, the ram engages the tab and the ram uses the tab to push the sear back so that the latch is pushed away from the hammer catch. The lever arm is biased up toward the hammer by the lever arm spring 74 so that the extension contacts the hammer's cam surface. In the lever arm's firing position, the hammer's cam surface engages the extension and forces the lever arm down as the hammer rotates from its cocked orientation to its discharge orientation, and this also causes the ram to disengage from the sear's tab. When the hammer is in its discharge orientation, the firing notch in the lever arm is forced onto the firing detent which prevents the lever arm and trigger from resetting at the same time that the firearm is being discharged. After the firearm discharges and the recoil mechanism begins cocking the hammer back, the cam surface rotates back with the hammer and allows the lever spring arm to bias the lever arm up off of the firing detent.

In the lever arm's safety position, the safety's cam pushes the lever arm down so that the safety notch is on the safety detent and the hook is around the safety catch. The safety notch/detent engagement prevents the trigger from moving from its rest position to its pulled position, and the hook/catch safety engagement prevents the sear from moving from its latching position to its releasing position. Due to weight and/or space limitations or to place the toggle bar in a quick release location on the handle, the cam may be offset from the top side of the lever arm. Accordingly, the lever arm may include a second extension 72*e* to contact the safety's cam that adjusts for the offset.

While one of ordinary skill in the art generally understand a cycle of operation for a semi-automatic pistol, a general cycle and its constituent phases, are described below, starting with a cartridge feeding phase of the cycle after a round has been fired from the pistol.

The cartridge feeding phase involves the upward movement of cartridges in a magazine 76 loaded into the pistol. This upward movement of cartridges is generally accomplished by a follower and a spring positioned within magazine. However, other methods of cartridge feeding may be used to move the rounds upward into the path of the pistol's slide by the magazine follower and spring assembly. The feeding phase may also include a ramping action that occurs as the pistol slide moves forward and starts to strip a cartridge forward from the magazine. It is important to note that, in many pistols, the barrel is not stationary with the frame of the pistol, but instead moves forward and backward during the entire cycle of operation, i.e., a floating barrel.

A cartridge chambering phase occurs next in the cycle of operation, where a cartridge is stripped from the magazine and placed into the chamber of the pistol. This stripping action occurs as the slide moves forward under compressed recoil spring pressure, which in turn pulls a cartridge from the magazine. The combined movement of the slide and the upward pressure of the follower/spring assembly in magazine push the cartridge up a frame/barrel ramp and into the chamber. In many prior art pistols, the front muzzle end of the barrel angles upward and the rearward firing chamber end of the barrel angles downward during this phase to effect the chambering of a cartridge. In the present invention, the barrel remains fixed with the frame and may even be integrally formed with the frame.

Next, the pistol enters a locking phase in which the cartridge is locked into place in the barrel with the firing mechanism at the rear of the cartridge. In the semi-automatic pistols in which the barrel rotates, the barrel and slide are held in place relative to the frame during this phase. As indicated above, according to one aspect of the present invention, the barrel remains fixed in place and does not move, and the slide is locked into position relative to both the barrel and the frame.

The cycle of operation then "suspends" at this stage, until an operator of the pistol pulls the pistol trigger, at which time the cycle of operation enters into a firing phase. A triggering mechanism releases a striker or another form of a hammer, whereby the striker transfers its energy to the firing pin, which, in turn, strikes the primer. The primer ignites the propellant charge in the chambered cartridge. The gas created by the ignited propellant charge expands behind the bullet, forcing the bullet away from the cartridge casing and down the barrel. Generally, the barrel and slide remain in position during this initial portion of the firing phase. In the final portion of the firing phase, the bullet exits the barrel through a muzzle and the gas pressure within the barrel drops. At this point, the inertial thrust of the exiting bullet imparts an equal rearward force on the slide assembly. As a result, the slide assembly moves rearward as the recoil spring assembly absorbs this "recoil" energy. It should be noted that the prior art pistols position the recoil spring beneath their respective floating barrels, the significance of which is discussed below.

At this point, the pistol enters an unlock phase, where the slide "unlocks", "unlinks" or otherwise disengages from the barrel and frame, such that the slide can move relative thereto. The next phase, the fired cartridge case extraction phase, often occurs during this phase due to the breaking of friction between the expended cartridge case and the chamber wall.

During the fired cartridge case extraction phase, the slide continues moving rearward and the breech opens. The rim of the fired cartridge case remains firmly in place, such as by an extractor and the continued rearward motion of the slide extracts the cartridge casing from the barrel. Finally, during the fired cartridge case ejection phase, the fired cartridge case is ejected through an ejection port. During the ejection, the cartridge case may be pivot upward and to one side which can free the case from the extractor. Finally, the pistol enters a cocking phase, whereby the striker and firing mechanism are positioned to fire the next cartridge. Generally, this occurs during the continued rearward motion of the slide.

One of ordinary skill in the art will appreciate that while these phases are described as separate, sequential phases, one or more of these phases may be combined, performed simultaneously or near simultaneously, and/or omitted as required for proper operation of a pistol, pistol or firearm. The particular safety action and operation of the firearm according to the present invention is described below with reference to the drawings shown in FIGS. 5A-5I.

Figure 5A:
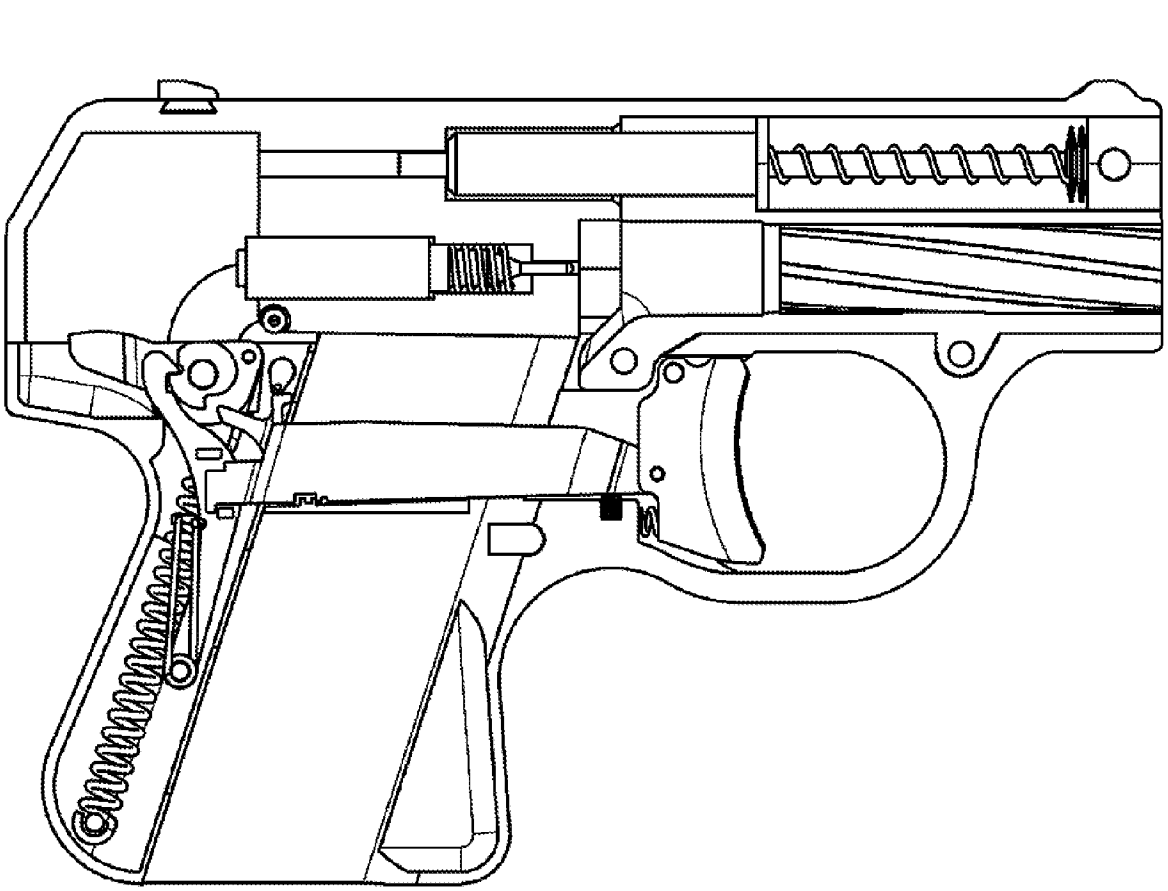
FIGS. 5A-5I are detail views of the progression for engaging the safety device, and cocking, release and return of the trigger assembly.

In FIG. 5A, the safety lock is engaged so that the pistol's firing system is in a non-firing arrangement. In this arrangement, the safety switch cam rotates down and pushes the lever arm down, and the sear safety hook engages the sear safety catch. With the lever arm pushed down in its lowered position, the trigger safety notch on the lever arm engages the trigger safety detent in the side of the frame. Additionally, with the lever arm in its lowered position, the lever arm ram is disengaged from the sear tab.

Figure 5B:
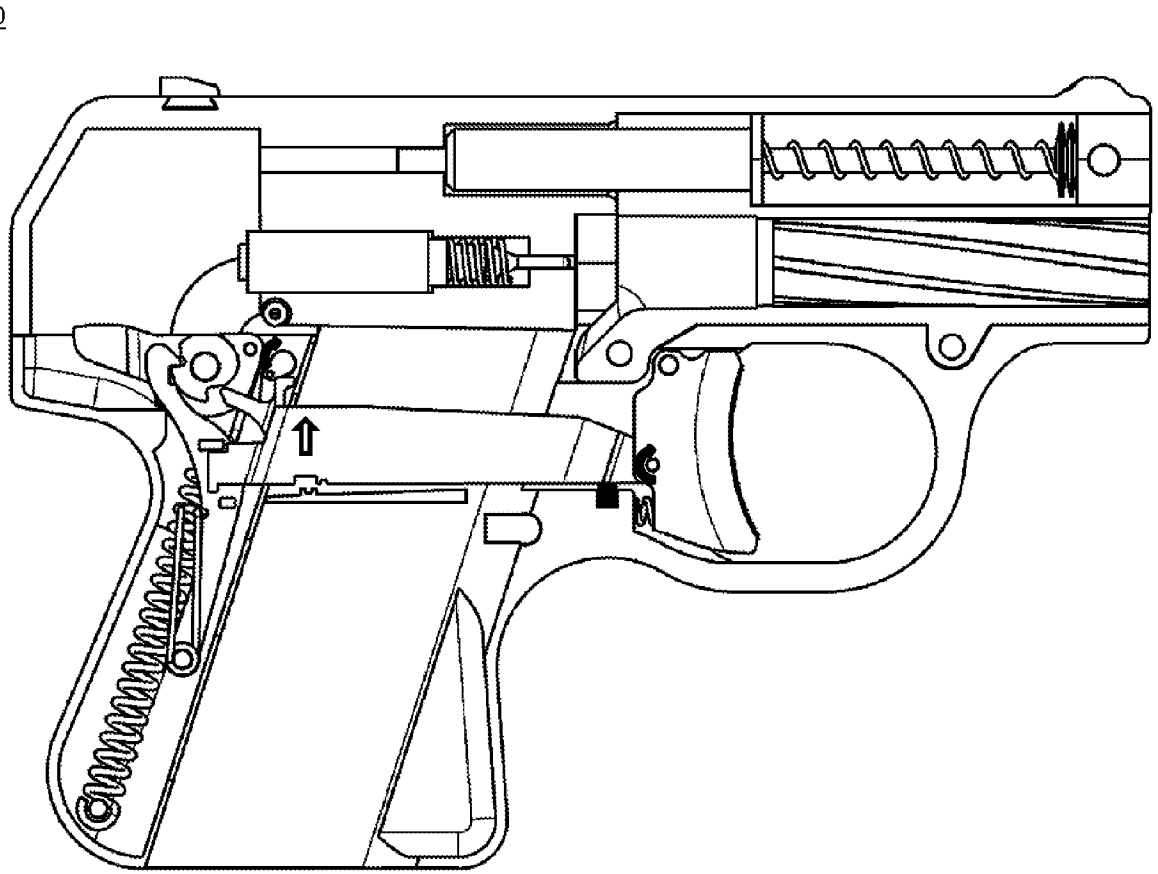

The operational sequence of firing the pistol and automatic reloading is shown in FIGS. 5B-5H. The firing-ready rest position is shown in FIG. 5B. In this position, the safety switch rotates the safety cam up so that the safety is off. With the safety off, the lever arm spring biases the lever arm up so that the sear safety hook is disengaged from the sear safety catch and the trigger safety notch is disengaged from the trigger safety detent. When the lever arm moves up, the lever arm ram engages the sear tab.

Figure 5C:
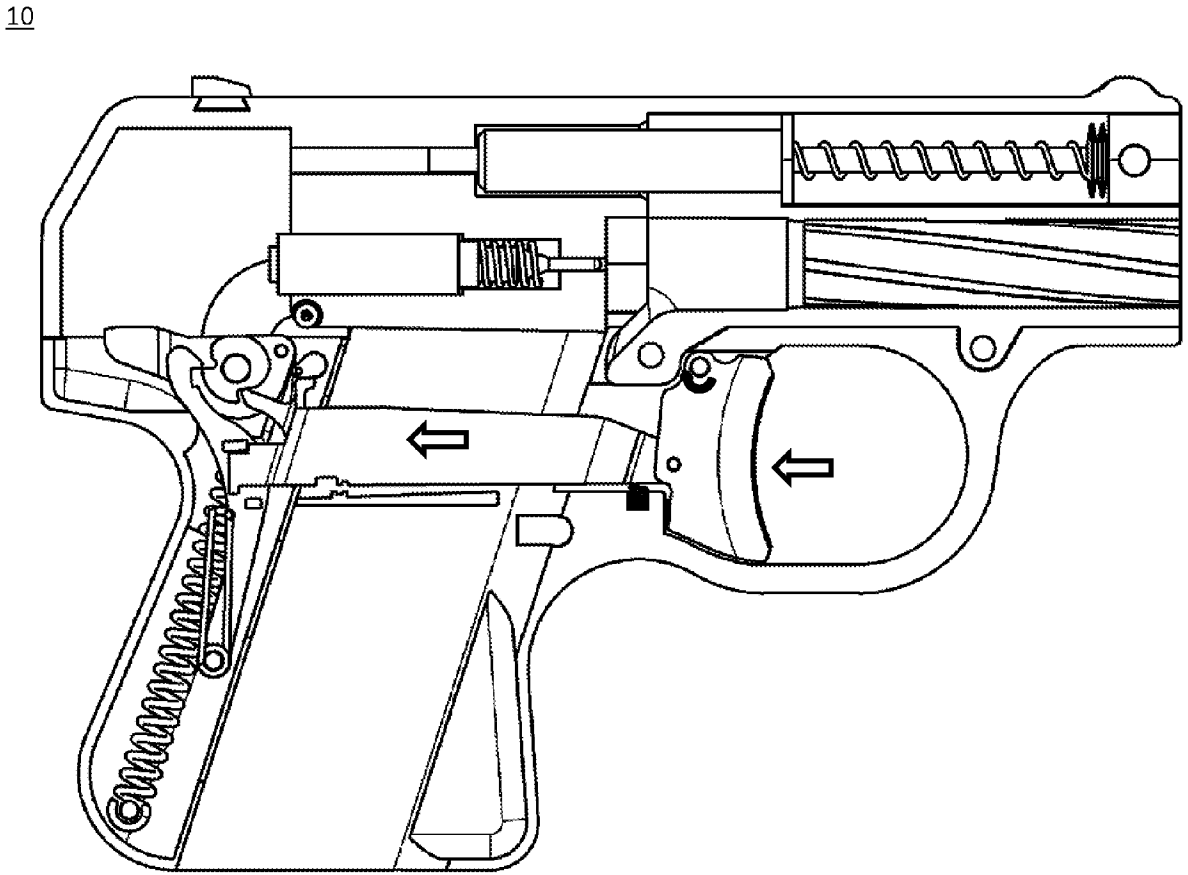
Figure 5D:
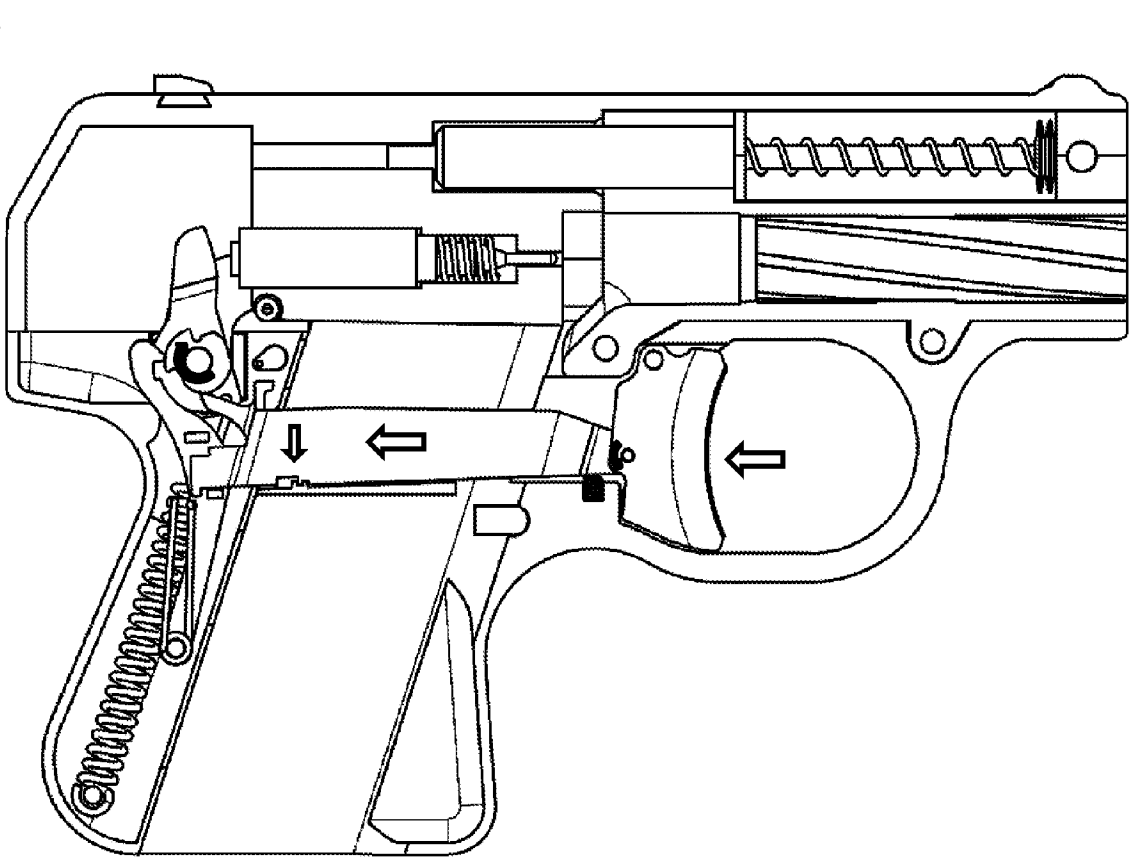
Figure 5E:
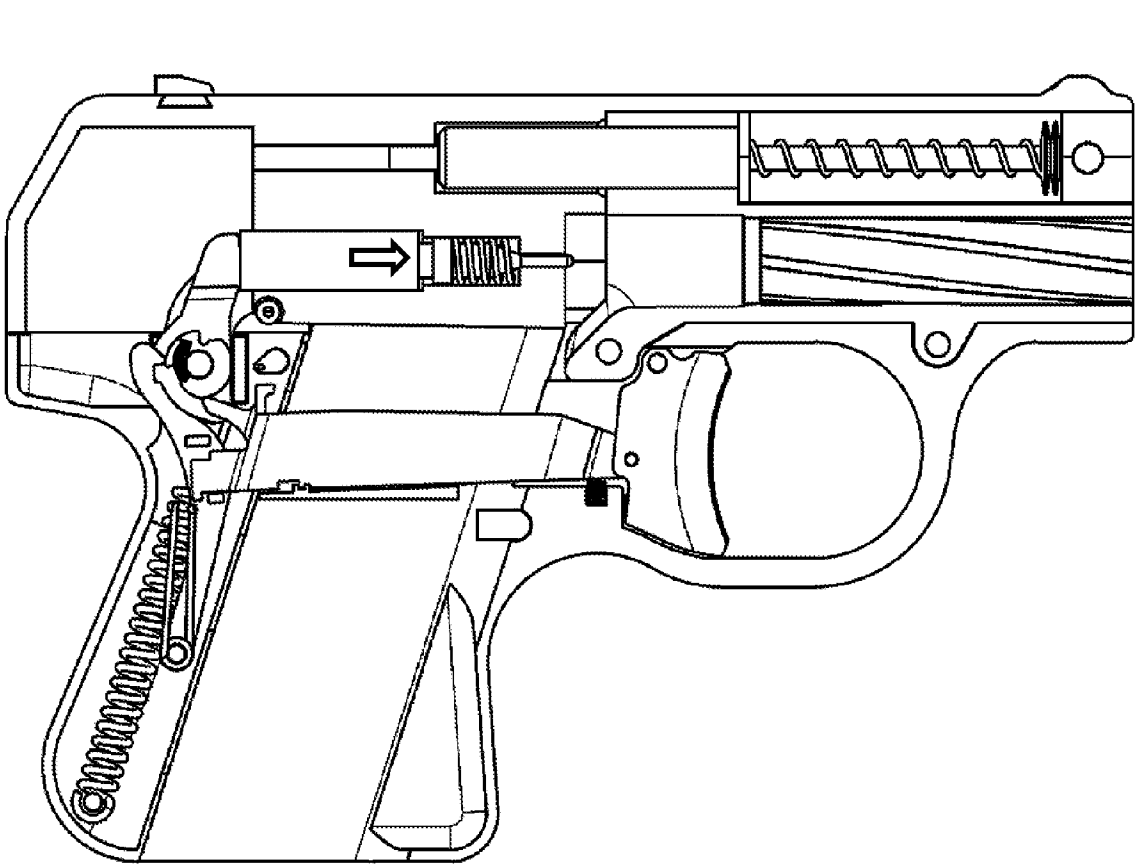

The firing-ready cocked position is shown in FIG. 5C. In this position, the sear is brought to its break point. The trigger pull is pressed inwardly, and the lever arm ram pushes the sear tab to the sear break point in which the sear latch is at the edge of the hammer catch. Also, at the sear break point, the lever arm extension engages the hammer cam. If the trigger pull is released, the trigger assembly returns to the rest position, with the trigger and lever arm being biased forward by the trigger spring, the lever arm remaining biased upward by the lever arm spring and the sear being biased forward by sear spring. Any further pull on the trigger causes the sear to release the hammer as shown in FIG. 5D. With the trigger pressed fully inward, the lever arm ram pushes the sear tab over the sear break point so that the sear latch moves past the edge of the hammer catch. The hammer spring forces the hammer to rotate around its pivot. The hammer cam forces the lever arm extension down and disengages the lever arm ram from the sear tab. While the trigger is depressed and the hammer has rotated to its firing position, the trigger safety notch engages the trigger safety detent to prevent a premature trigger reset. As shown in FIG. 5E, the hammer rotates fully to hit the linear striker which causes the firing pin to hit the primer in the cartridge, discharging the round and firing the bullet.

Figure 5F:
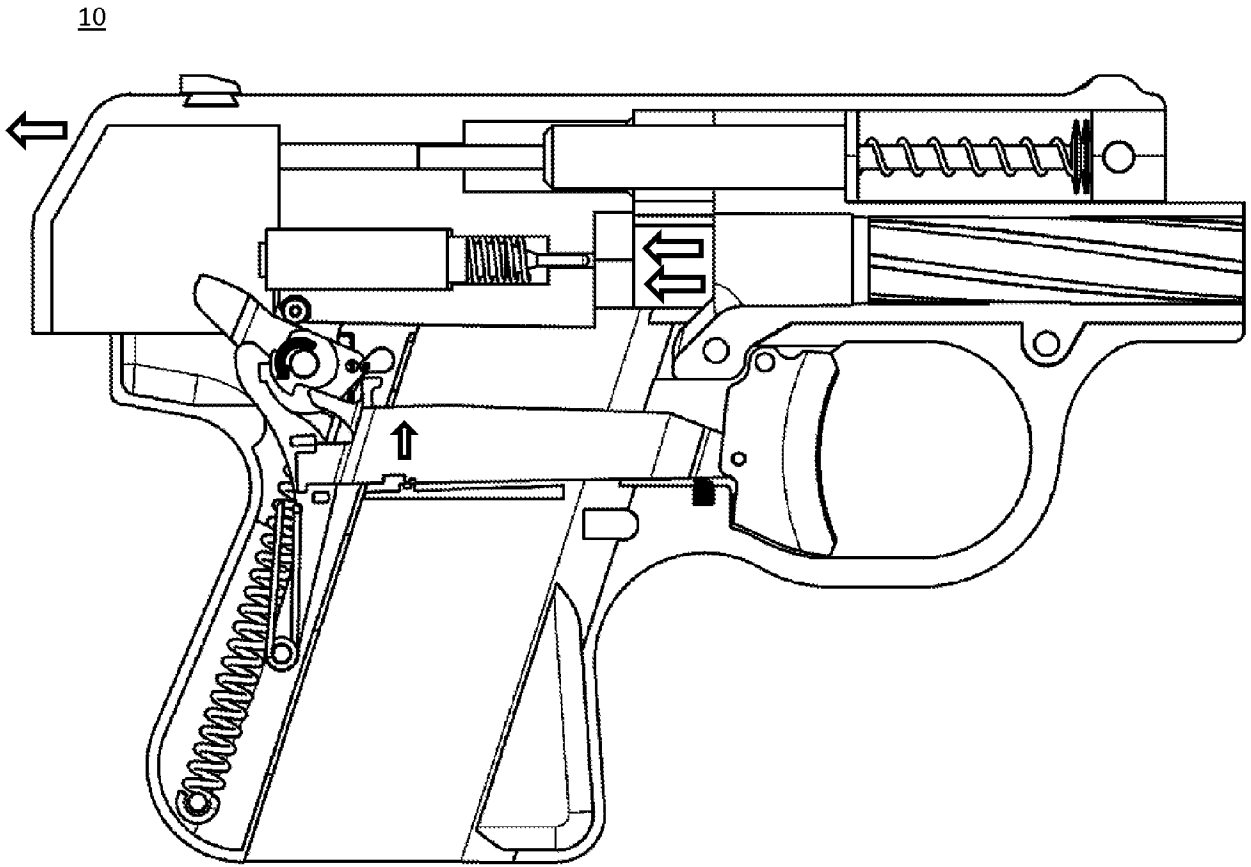
Figure 5G:
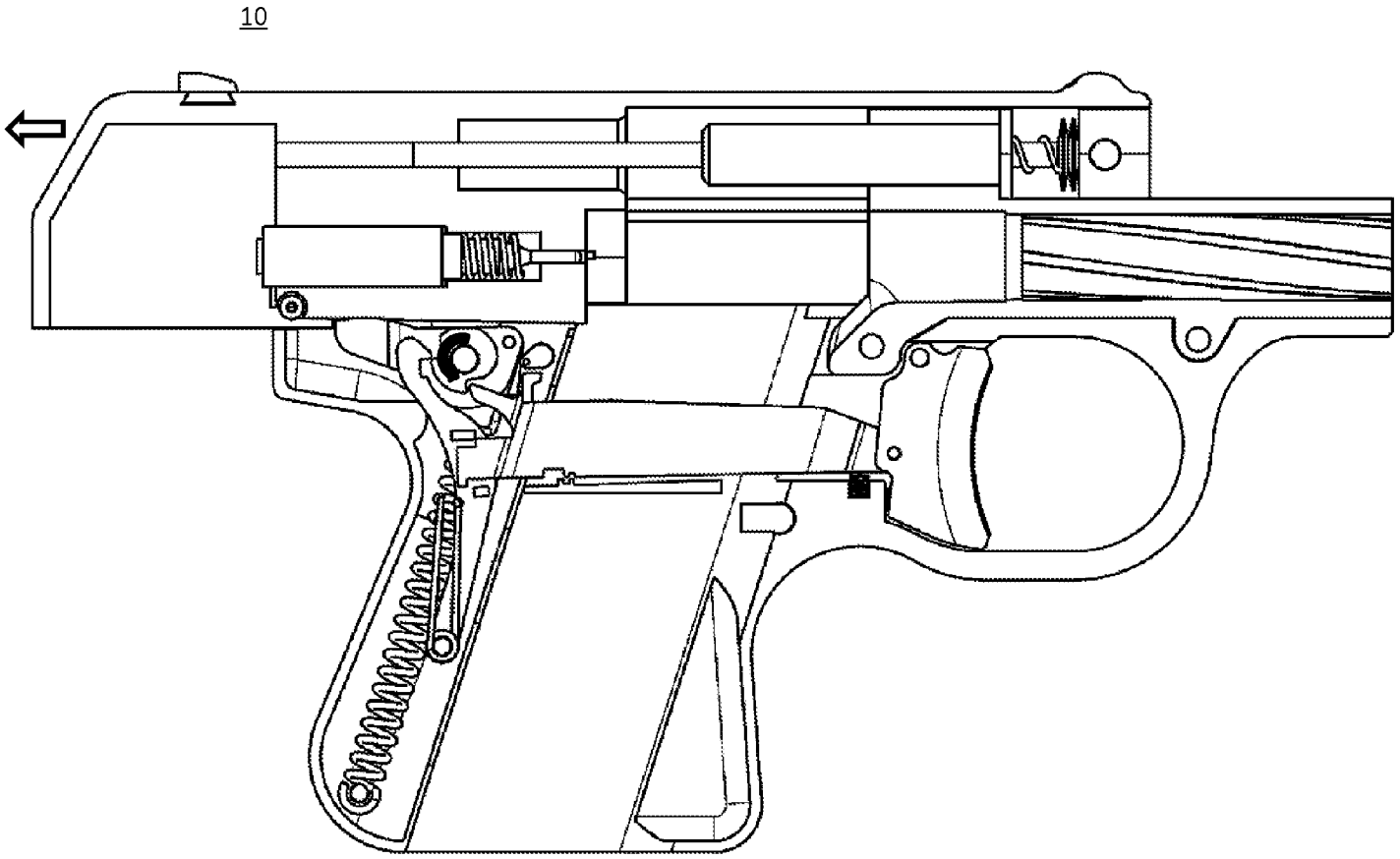

As shown in FIGS. 5F and 5G, the discharge of the cartridge results in a force being applied through its base against the breach plate. The slide is forced back, and the hammer is cocked. The slide bearing surface pushes the hammer so that it rotates back around its pivot. The hammer cam allows the lever arm extension up, and the lever arm spring biases the lever arm up. The lever arm spring pushes the lever arm up against the sear tab while the trigger remains pressed inward, but the ram may not fully engage the sear tab until the trigger pull is released. The slide fully cocks the hammer and the next cartridge in the clip is auto-loaded into the firing chamber. The slide bearing surface fully cocks the hammer, and the sear spring biases the sear forward so that the sear latch engages the hammer catch. The spent shell is forced out of the cartridge firing chamber.

Figure 5H:
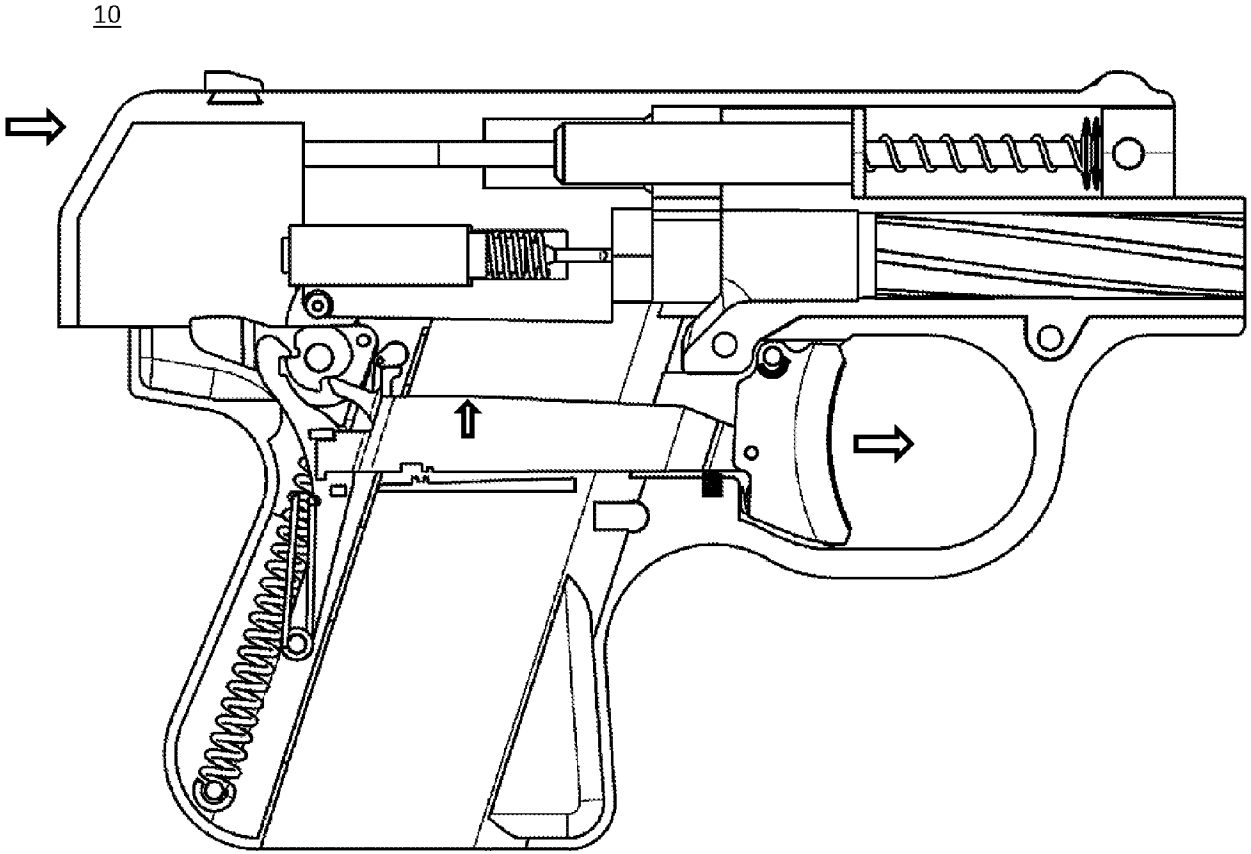

As shown in FIG. 5H, the recoil spring biases the slide forward and returns the slide to the firing ready position. When the trigger pull is released, the trigger and lever arm are biased forward by the trigger spring. The lever arm spring pushes the lever arm up further to engage the sear tab. The sear spring biases the sear to its forward-most position where the sear latch is seated on the hammer catch, and the next round in the magazine is forced into cartridge firing chamber.

Figure 5I:
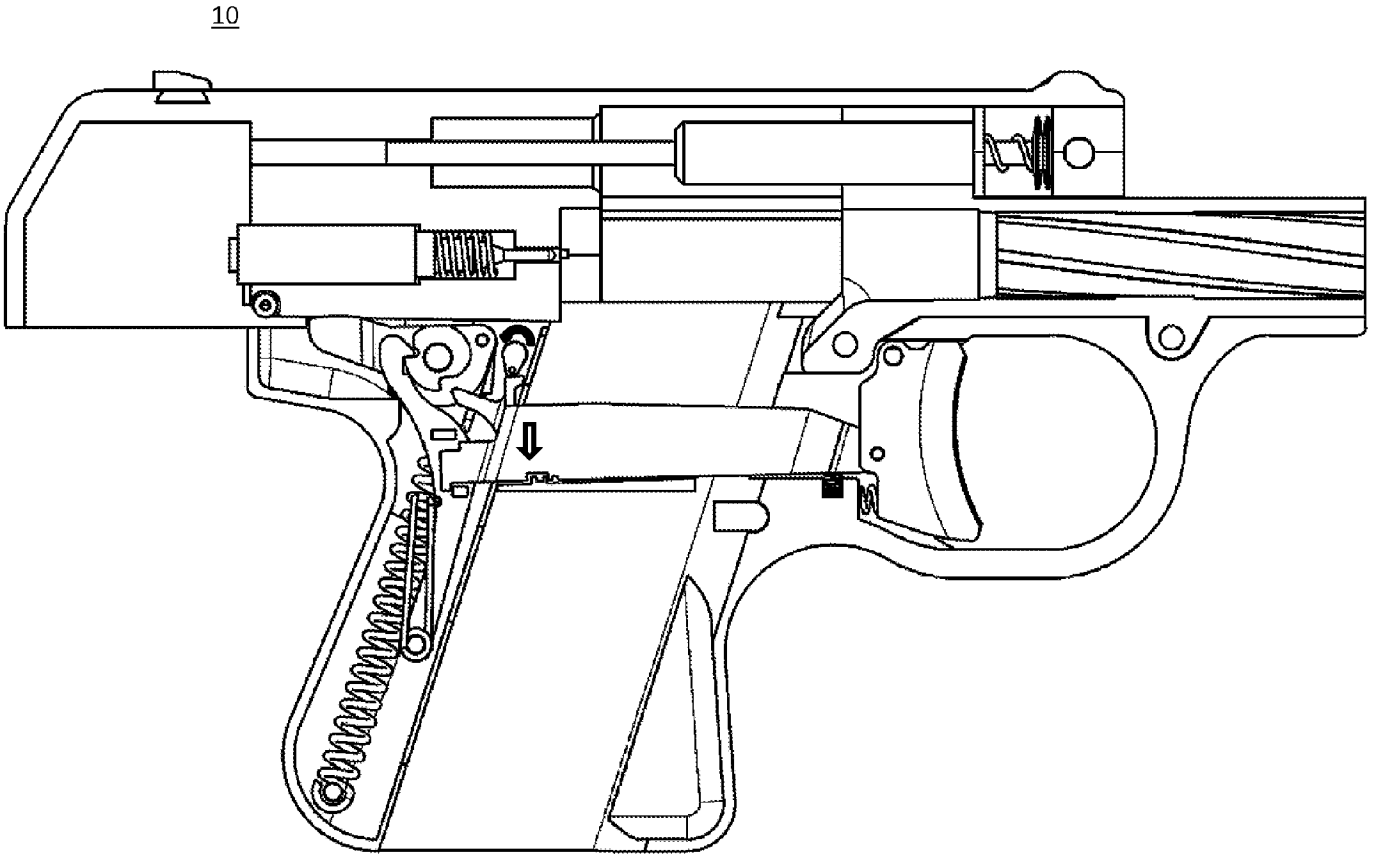

When there are no additional rounds in the magazine, the clip may hold the slide open. As shown in FIG. 5I, the safety lock can be engaged to lock the slide in its open position and prevent the slide from returning to its firing ready position. A loaded magazine can be inserted into the handle and the safety can be released to chamber the first round.

As indicated above, the position of the recoil assembly above the barrel assembly permits the barrel of the gun to be positioned closer to the trigger and thereby closer to the operator's hand that is holding the firearm at the handle grip. In one example of a compact semi-automatic pistol, the centerline of the barrel can be positioned at or less than approximately one-half inch from the top of the trigger guard. The small offset is possible even with a barrel that handles 45 caliber ammunition, having a bullet diameter of approximately 0.452" and a base diameter of approximately 0.476", and can be even have offsets under one-half inch with smaller diameter barrels which handle smaller caliber ammunition. Generally, in the present invention, the offset distance between a bottom of the barrel and the top portion of the trigger is less than a diameter of the barrel.

The closer proximity of the barrel centerline to the trigger pull and the top of the handle reduces the moment arm between the location where the kickback force pushes against the firearm, i.e., within the barrel, and where the operator of the firearm must exert a force to stabilize the firearm, i.e., at the handle grip and trigger. A smaller moment arm can significantly reduce the torque that an operator must overcome in holding the firearm as it is discharged, thereby allowing for much more accuracy in successive shots that are then fired. For example, for a typical semi-automatic pistol that has a recoil energy of approximately 4,500 in-lb, a barrel-to-handgrip distance of an inch or more would result in over 4,500 in-lb in torque that the operator must overcome. Even for a compact semi-automatic pistol, a barrel-to-handgrip distance that is a little less than an inch or around ⅞" would result in approximately 4,000 in-lb in torque. In comparison, with the top-mounted recoil mechanism of the present invention in a traditional semi-automatic pistol design, the barrel-to-handgrip offset can be brought to within approximately one-half inch (½") or less which would reduce the torque to less than 2,250 in-lb.

The operation of the firearms described above, including one or more elements of the present invention, generally proceed according to the cycle of operation indicated above, subject to the same disclaimers described above regarding the combination of phases, the simultaneous or near-simultaneous execution of phases, and/or omission of phases as required for the proper operation of the firearm. The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, it would be within the scope of the present invention to incorporate any known firing pin block which is directly connected to the trigger and prevents or otherwise stops the firing pin from extending into the cartridge firing chamber and contacting the cartridge primer except when the trigger is pulled, an example of which is described in U.S. Pat. No. 3,830,002 and which is incorporated by reference herein. Thus, the breadth and scope of the present invention should not be limited by any of the above-described exemplary embodiments, but should be defined only in accordance with the following claims appended hereto and their equivalents.

What is claimed is:

1. A firearm for discharging ammunition, comprising:

a frame comprising a handle portion and a trigger portion, wherein said handle portion is comprised of a first side and a second side extending from said trigger portion to a butt end of said frame;

a barrel assembly situated over said trigger portion, wherein said barrel assembly is comprised of a gun barrel and a housing extending from a top side of said gun barrel, and wherein said housing has an inner surface and a front surface;

a recoil assembly comprising a recoil rod, a helical spring and a sleeve, wherein said recoil rod comprises a nose portion and an elongated rod extending from said nose portion, wherein said sleeve has a flange around a first open end and an annular rib at a second open end, wherein said elongated rod extends through an interior portion of said sleeve and projects out said second open end, wherein said helical spring surrounds said elongated rod and is contained between said nose portion and said annular rib, wherein an outer surface of said sleeve is contained within said inner surface of said housing, and wherein said flange abuts said front surface of said housing;

a slide assembly comprising a front casing, an internal recess, a breech plate, a rear casing, a firing pin bore, and a conduit between said internal recess and said rear casing, wherein said front casing extends from said internal recess to a distal end around said nose portion of said recoil rod, wherein said front casing mates with said barrel and encloses said recoil assembly in an interior space between said front casing and said top side of said barrel, wherein said distal end of said front casing is fixedly connected to said nose portion of said recoil assembly, wherein said breech plate has a firing pin hole aligned with said firing pin bore, wherein said front casing is slidably connected to said top side of said barrel, and wherein said rear casing is slidably connected to said first side and said second side of said handle portion proximate to said butt end of said frame.

2. The firearm of claim 1, wherein said barrel assembly is integrally formed with and permanently attached to said frame.

3. The firearm of claim 1, wherein said barrel assembly is removably connected to said frame through at least one takedown pin.

4. The firearm of claim 3, further comprising a first takedown pin and a second takedown fixedly connecting said barrel assembly to said frame, wherein said takedown pins are removable for removing said barrel assembly from said frame, wherein said trigger portion is further comprised of an arm extending from said handle portion and a cavity recessed from a top face of said arm, wherein a pair of sides of said arm extend from said first side and said second side of said handle portion to form a pair of side walls on opposite sides of said cavity, wherein each of said side walls has a side wall aperture, wherein said barrel assembly is further comprised of a front mount and a rear mount extending from a bottom side of said gun barrel at said front portion and said rear portion, respectively, wherein said front mount is seated in said cavity and has a front aperture aligned with said side wall aperture in each of said side walls, wherein said first takedown pin extends through said front aperture and said side wall aperture in each one of said side walls, wherein said rear mount is seated between said first side and said second side and has a rear aperture aligned between said side wall apertures, and wherein said second takedown pin extends through said rear aperture, said first side aperture and said second side aperture.

5. The firearm of claim 3, wherein said barrel assembly modularly connects with said frame and said slide assembly, wherein a first barrel assembly has a first caliber and a second barrel assembly has a second caliber, and wherein said first barrel assembly is interchangeable with said second barrel assembly.

6. The firearm of claim 3, wherein said barrel assembly is further comprised pin mount and a latch mount, and wherein said latch mount engages with a catch on said frame.

7. The firearm of claim 1, further comprising a pin fixedly locking said recoil assembly to said slide assembly, wherein said front casing of said slide assembly further comprises a pair of apertures, wherein said nose portion of said recoil rod comprises a bore, and wherein said pin extends through said pair of apertures and said bore.

8. The firearm of claim 1, wherein said first side of said frame has a first lip proximate to a top end of said handle portion extending toward said butt end, wherein said second side has a second lip proximate to said top end extending toward said butt end, wherein said top side of said gun barrel is further comprised of a pair of longitudinal ribs extending along a length of said top side from a front portion of said gun barrel to a rear portion of said gun barrel, wherein said front casing of said slide assembly comprises a pair of inwardly-facing grooves extending from said distal end to a location proximate to said internal recess, wherein said pair of longitudinal ribs slide in said pair of inwardly-facing grooves, wherein said rear casing comprises a pair of outwardly-facing grooves, and wherein said first lip and said second lip slide in said pair of outwardly-facing grooves.

9. The firearm of claim 1, further comprising a trigger assembly within said handle of said frame and a linear striker assembly within said firing pin hole, wherein said trigger assembly comprises:

a hammer pivotally mounted to said frame;

a hammer spring biasing said hammer to a discharge orientation;

a trigger having a rest position and a pulled position, wherein said trigger has a top portion proximate to said trigger portion of said frame;

a sear engaging said hammer, wherein said sear has a latching position holding said hammer in a cocked orientation and has a releasing position allowing said hammer to rotate to said discharge orientation according to said hammer spring biasing, wherein said sear comprises a tab and a sear safety catch;

a safety switch having a safety-on position and a safety-off position, wherein said safety switch comprises a toggle bar and a cam connected to said toggle bar, wherein said toggle bar rotates said cam between said safety-on position and said safety-off position;

a lever arm connecting said trigger to said sear, said lever arm comprising a ram, an extension, a hook and a notch, wherein said lever arm has a ready position, a firing position and a safety position, wherein said ram engages said tab when said lever arm is in said ready position, wherein said hammer engages said extension when said lever arm is in said firing position and said hammer forces said ram to disengage from said tab as said hammer rotates from said cocked orientation to said discharge orientation, wherein said cam forces said notch into a first safety engagement with a detent and forces said hook into a second safety engagement with said catch when said toggle bar rotates said cam from said safety-off position to said safety-on position, and wherein said first safety engagement prevents said trigger from moving from said rest position to said pulled position and said second safety engagement prevents said sear from moving from said latching position to said releasing position.

10. The firearm of claim 1, wherein a centerline of said gun barrel is positioned at or less than one-half inch from a trigger pull at its topmost exposed portion, wherein said distal end of said front casing has an open end face, and wherein said nose portion of said recoil rod closes said interior space.

11. The firearm of claim 1, wherein an offset distance between a centerline of said gun barrel and a topmost exposed portion of a trigger pull is less than a diameter of said gun barrel.

12. A firearm for discharging ammunition, comprising:

a frame comprising a handle portion and a trigger portion, wherein said handle portion is comprised of a first side and a second side extending from said trigger portion to a butt end of said frame;

a barrel assembly removably connected to said frame, wherein said barrel assembly is comprised of a gun barrel and a housing extending from a top side of said gun barrel, and wherein said housing has an inner surface and a front surface, wherein said barrel assembly modularly connects with said frame, wherein said barrel assembly is selected from a group of modular barrel assemblies consisting of a first barrel assembly having a first caliber and a second barrel assembly having a second caliber, and wherein said first barrel assembly is interchangeable with said second barrel assembly;

a recoil assembly comprising a recoil rod, a helical spring and a sleeve, wherein said recoil rod comprises a nose portion and an elongated rod extending from said nose portion, wherein said sleeve has a flange around a first open end and an annular rib at a second open end, wherein said elongated rod extends through an interior portion of said sleeve and projects out said second open end, wherein said helical spring surrounds said elongated rod and is contained between said nose portion and said annular rib, wherein an outer surface of said sleeve is contained within said inner surface of said housing, and wherein said flange abuts said front surface of said housing;

a slide assembly comprising a front casing, an internal recess, a breech plate, a rear casing, a firing pin bore, and a conduit between said internal recess and said rear casing, wherein said front casing extends from said internal recess to a distal end around said nose portion of said recoil rod, wherein said front casing mates with said barrel and encloses said recoil assembly in an interior space between said front casing and said top side of said barrel, wherein said distal end of said front casing is fixedly connected to said nose portion of said recoil assembly, wherein said breech plate has a firing pin hole aligned with said firing pin bore, wherein said front casing is slidably connected to said top side of said barrel, and wherein said rear casing is slidably connected to said first side and said second side of said handle portion proximate to said butt end of said frame.

13. The firearm of claim 12, further comprising a first takedown pin and a second takedown pin fixedly connecting said barrel assembly to said frame, wherein said takedown pins are removable for removing said barrel assembly from said frame, wherein said trigger portion is further comprised of an arm extending from said handle portion and a cavity recessed from a top face of said arm, wherein a pair of sides of said arm extend from said first side and said second side of said handle portion to form a pair of side walls on opposite sides of said cavity, wherein each of said side walls has a side wall aperture, wherein said barrel assembly is further comprised of a front mount and a rear mount extending from a bottom side of said gun barrel at said front portion and said rear portion, respectively, wherein said front mount is seated in said cavity and has a front aperture aligned with said side wall aperture in each of said side walls, wherein said first takedown pin extends through said front aperture and said side wall aperture in each one of said side walls, wherein said rear mount is seated between said first side and said second side and has a rear aperture aligned between said side wall apertures, and wherein said second takedown pin extends through said rear aperture, said first side aperture and said second side aperture.

14. The firearm of claim 12, wherein said barrel assembly is further comprised pin mount and a latch mount, and wherein said latch mount engages with a catch on said frame.

15. The firearm of claim 12, wherein an offset distance between a centerline of said gun barrel and a topmost exposed portion of a trigger pull is less than a diameter of said gun barrel, wherein said distal end of said front casing has an open end face, and wherein said nose portion of said recoil rod closes said interior space.

16. The firearm of claim 12, further comprising a pin fixedly locking said recoil assembly to said slide assembly, wherein said front casing of said slide assembly further comprises a pair of apertures, wherein said nose portion of said recoil rod comprises a bore, and wherein said pin extends through said pair of apertures and said bore, wherein said first side of said frame has a first lip proximate to a top end of said handle portion extending toward said butt end, wherein said second side has a second lip proximate to said top end extending toward said butt end, wherein said top side of said gun barrel is further comprised of a pair of longitudinal ribs extending along a length of said top side from a front portion of said gun barrel to a rear portion of said gun barrel, wherein said front casing of said slide assembly comprises a pair of inwardly-facing grooves extending from said distal end to a location proximate to said internal recess, wherein said pair of longitudinal ribs slide in said pair of inwardly-facing grooves, wherein said rear casing comprises a pair of outwardly-facing grooves, and wherein said first lip and said second lip slide in said pair of outwardly-facing grooves.

17. The firearm of claim 12, further comprising a trigger assembly within said handle of said frame and a linear striker assembly within said firing pin hole.

18. A firearm for discharging ammunition, comprising:

a frame comprising a handle portion and a trigger portion, wherein said handle portion is comprised of a first side and a second side extending from said trigger portion to a butt end of said frame, wherein said first side is further comprised of a first side aperture proximate to said trigger portion and a first lip proximate to a top end of said handle portion extending toward said butt end, wherein said second side is further comprised of a second side aperture proximate to said trigger portion and a second lip proximate to said top end extending toward said butt end, wherein said trigger portion is comprised of an arm extending from said handle portion and a cavity recessed from a top face of said arm, wherein a pair of sides of said arm extend from said first side and said second side of said handle portion to form a pair of side walls on opposite sides of said cavity, and wherein each of said side walls has a side wall aperture;

a barrel assembly positioned adjacent to said top face of said arm, wherein said barrel assembly is comprised of a gun barrel, a front mount, a rear mount and a housing, wherein said barrel assembly has a front portion, a rear portion, a top side, and a bottom side, wherein said front mount extends from said bottom side of said front portion, wherein said rear mount extends from said bottom side of said rear portion, wherein said housing extends from said top side of said gun barrel and has an inner surface and a front surface, wherein said top side is further comprised of a pair of longitudinal ribs extending between said front portion and said rear portion, wherein said front mount is seated in said cavity and has a front aperture aligned with said side wall aperture in each of said side walls, and wherein said rear mount is seated between said first side and said second side and has a rear aperture aligned with said first side aperture and said second side aperture;

a pair of takedown pins locking said barrel assembly to said frame, wherein a first takedown pin extends through said front aperture and said side wall aperture in each one of said side walls, wherein a second takedown pin extends through said rear aperture, said first side aperture and said second side aperture;

a recoil assembly comprising a recoil rod, a helical spring and a sleeve, wherein said recoil rod comprises a nose portion and an elongated rod extending from said nose portion, wherein said nose portion comprises a bore, wherein said sleeve has a flange around a first open end and an annular rib at a second open end, wherein said elongated rod extends through an interior portion of said sleeve and projects out said second open end, wherein said helical spring surrounds said elongated rod and is contained between said nose portion and said annular rib, wherein an outer surface of said sleeve is contained within said inner surface of said housing, and wherein said flange abuts said front surface of said housing;

a slide assembly comprising a front casing, an internal recess, a breech plate, a rear casing, a firing pin bore, and a conduit between said internal recess and said rear casing, wherein said breech plate has a firing pin hole aligned with said firing pin bore, wherein said front casing extends from said internal recess to a distal end around said nose portion of said recoil rod, wherein said front casing mates with said barrel and encloses said recoil assembly in an interior space between said front casing and said top side of said barrel, wherein said front casing comprises a pair of apertures at said distal end and a pair of inwardly-facing grooves extending from said distal end to a location proximate to said internal recess, wherein said pair of longitudinal ribs slide in said pair of inwardly-facing grooves, wherein said rear casing comprises a pair of outwardly-facing grooves, wherein said first lip and said second lip slide in said pair of outwardly-facing grooves; and a pin extending through said pair of apertures in said front casing of said slide assembly and through said bore in said nose portion of said recoil assembly.

19. The firearm of claim 18, wherein said barrel assembly modularly connects with said frame and said slide assembly, wherein a first barrel assembly has a first caliber and a second barrel assembly has a second caliber, and wherein said first barrel assembly is interchangeable with said second barrel assembly.

20. The firearm of claim 18, wherein an offset distance between a centerline of said gun barrel and a topmost exposed portion of a trigger pull is less than a diameter of said gun barrel, wherein said distal end of said front casing has an open end face, and wherein said nose portion of said recoil rod closes said interior space.

* * * * *